United States Patent [19]

Asano

[11] 4,029,061

[45] June 14, 1977

[54] APPARATUS FOR CONTROLLING THE AIR-FUEL MIXTURE RATIO OF INTERNAL COMBUSTION ENGINE

[75] Inventor: Masaharu Asano, Yokohama, Japan

[73] Assignee: Nissan Motor Co., Ltd., Yokohama, Japan

[22] Filed: Oct. 14, 1975

[21] Appl. No.: 622,056

[30] Foreign Application Priority Data

| | | |
|---|---|---|
| Oct. 21, 1974 | Japan | 49-121166 |
| Oct. 21, 1974 | Japan | 49-121167 |
| Mar. 18, 1975 | Japan | 50-31870 |

[52] U.S. Cl. ..... 123/32 EE; 60/276; 60/285

[51] Int. Cl.² ..... F02B 3/00

[58] Field of Search ..... 123/32 CA, 32 EE; 60/274, 276, 285

[56] References Cited

UNITED STATES PATENTS

| | | | |
|---|---|---|---|
| 3,738,341 | 6/1973 | Loos | 123/32 EA |
| 3,782,347 | 1/1974 | Schmidt | 123/32 EA |
| 3,875,907 | 4/1975 | Wessel | 123/32 EA |
| 3,900,012 | 8/1975 | Wahl | 123/32 EA |
| 3,963,009 | 6/1976 | Mennesson | 60/276 |

*Primary Examiner*—Ronald B. Cox
*Attorney, Agent, or Firm*—Lowe, King, Price & Markva

[57] ABSTRACT

The oxygen component of exhaust gases from internal combustion engine is sensed and compared with a reference value which represents the stoichiometric air-fuel ratio of the engine to provide an error signal at one of two discrete values depending on whether the amount of oxygen component is above or below stoichiometry. The error signal is connected to integrating and/or proportional controllers. Operating parameters of the engine are sensed to control the integrating and/or proportional gains of the controllers upon the sensed parameters reaching a predetermined value. The output from the controllers is used to control the air-fuel ratio of the engine.

7 Claims, 8 Drawing Figures

APPARATUS FOR CONTROLLING THE AIR-FUEL MIXTURE RATIO OF INTERNAL COMBUSTION ENGINE

The present invention relates generally to air-fuel mixture control apparatus particularly applicable to internal combustion engines, and particularly to a closed loop air-fuel mixture control system.

Various methods and systems have been proposed for minimizing the amount of polluting components in the exhaust gases from internal combustion engines. The oxygen content of the exhaust gases is measured by means of an oxygen sensing device formed of a hollow tube of zirconium dioxide, plated with a thin coating of platinum on both inside and outside surfaces. The sensor produces an output voltage with a very sharp characteristic change in amplitude at the stoichiometric air-fuel mixture ratio. The sensed oxygen content is represented by the output voltage which is compared with the desired value. An integrating and/or proportional controllers detect the changes in the voltage and generate a control, or feedback signal necessary to adjust the fuel supplied to the cylinders of the engine so that the desired exhaust gas composition is obtained.

One of the response characteristics of a closed loop controlled system is the delay time which is defined as the time from the instant of disturbance of the system until a response is observed. The existance of the delay time can cause the control signal to oscillate. The repetition frequency of the oscillation is dependent on the delay time. The degree of perturbation from the stoichiometric air-fuel is also dependent on the delay time if the gains of the controllers are held contant.

The delay time is in turn dependent on the engine speed, the intake air flow and the velocity of gases emitted from the exhaust passage, among which the engine speed and intake air flow are primary factors that influence the delay time.

The primary object of the present invention is therefore to provide an improved closed loop air fuel mixture control system in which the controller gains are controlled by one of the engine parameters such as speed and intake air flow.

Another object of the invention is to keep the perturbation of air-fuel ratio from stoichiometry within a constant range of variation irrespective of the engine operating parameters.

These and other objects and advantages of the invention will become apparent when the following description is read in conjunction with the accompanying drawings, in which.

In one aspect of the present invention, one of the engine parameters, such as engine speed, is used to control the integrating controller gain in order to minimize the amplitude of the response oscillation of the closed loop due to the response delay time existing in the closed loop. A feature of the invention is in the use of a slicer circuitry which is responsive to an error signal derived from a comparator connected to the output of the oxygen sensor and is also responsive to a signal representative of the engine speed. The slicer cuts off the upper and lower levels of the error signal in accordance with the speed representative signal. When disturbance occurs, the ratio of air to fuel perturbs from stoichiometry and the response oscillates due to the delay time. As the engine speed increases, the repetition frequency of the oscillation increases. Otherwise stated, the error signal appears as a series of pulses at one of two discrete values depending on whether the air-fuel ratio is above or below stoichiometry, and the duration of the pulses becomes narrower as the speed of the engine increases. The levels at which the pulses of the error signal are sliced are so controlled that the output of the slicer is a train of pulses having amplitude proportional to the engine speed, while the pulse duration is inversely proportional to the engine speed. The slicer output is connected to integrating controller having a constant integrating gain. The controller is so adjusted that it provides integration in one direction as the slicer output is above a predetermined level and in the other direction as the slicer output is below the predetermined level cancelling the previous integration. Although the integration gain is held constant, the output of the controller rises at different rates in response to each pulse of the slicer output due to its pulse amplitude being proportional to the engine speed and to its pulse duration being inversely proportional thereto.

In another aspect of the invention, the integrating or proportional gain of the controllers is controlled in response to the engine parameter. Throttle position may be used as a means for controlling the gain of the controllers.

Figure 1:
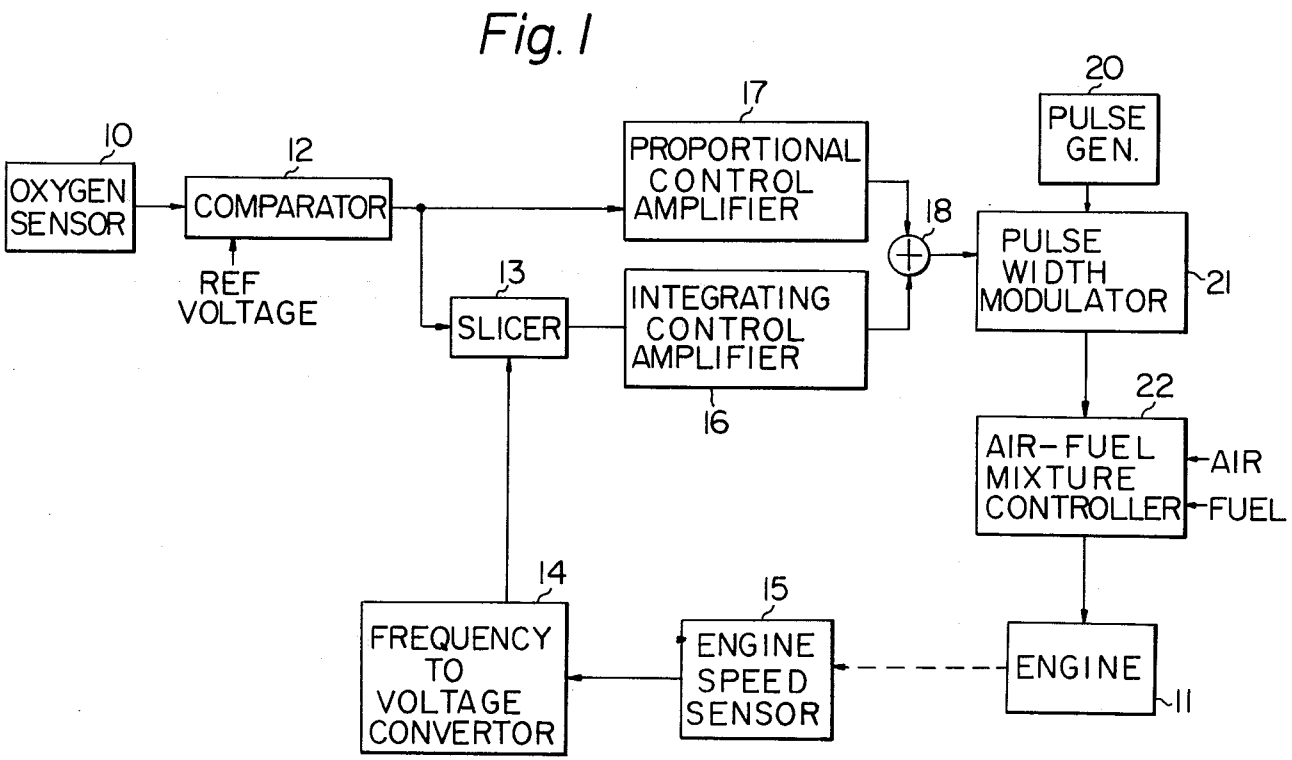
FIG. 1 is a circuit block diagram of a first embodiment of the present invention.

Referring now to FIG. 1, there is shown a first embodiment of the present invention. An oxygen sensor 10 such as a zirconium dioxide type is located in the passage of the exhaust gases emitted from the engine 11 to generate an electrical signal representative of the amount of oxygen contained in the exhaust gases. The sensor 10 is connected to a comparator 12 such as a differential amplifier which compares the oxygen representative signal with a reference voltage to provide a step-like error signal. The error signal from the comparator 12 assumes one of two discrete values depending on whether the sensed oxygen is above or below stoichiometric air-fuel ratio represented by the reference voltage and thus represents a perturbation from the desired air-fuel ratio. This signal is applied to a slicer 13 which is connected to the output of comparator 12 and to the output of a frequency-voltage convertor 14.

An engine speed sensor 15 is provided to detect the speed of the engine 11 to provide speed related electrical pulses. These pulses are converted into a voltage signal by the frequency-to-voltage convertor 14. The amplitude of the voltage signal from the convertor 14 is thus proportional to the engine speed.

The slicer 13 utilizes the speed proportional voltage to derive an inverse voltage which is inversely proportional to the engine speed. These two speed-related voltage signals are used to cut off the level of the comparator output so that the pulses from comparator 12 fluctuate within the voltage levels defined by the speed related voltages.

The output from the slicer 13 is connected to an integrating control amplifier 16 in which the error signal is integrated by the amplifier 16. The error signal may also be connected to a proportional control amplifier 17 in which the error signal is multiplied by the amplifier gain by a constant amount. Proportional control is preferable since the use of integral control alone may result in sluggish performance of the system.

The outputs from the integrating and proportional control amplifiers 16 and 17 are connected to an adder 18 to provide summation of the two signals.

A pulse generator 20 is provided to generate a series of pulses which is applied to a pulse width modulator 21 to which is also applied an output from the adder 18 in order to modulate the duration of the generated pulses in accordance with the adder output.

Carburetor or electronic fuel injection control valve is represented by an air-fuel mixture controller 22 which controls the ratio of air-to-fuel supplied to the engine 11 in accordance with the width of the pulses supplied from the pulse width modulator 21.

Figure 3:
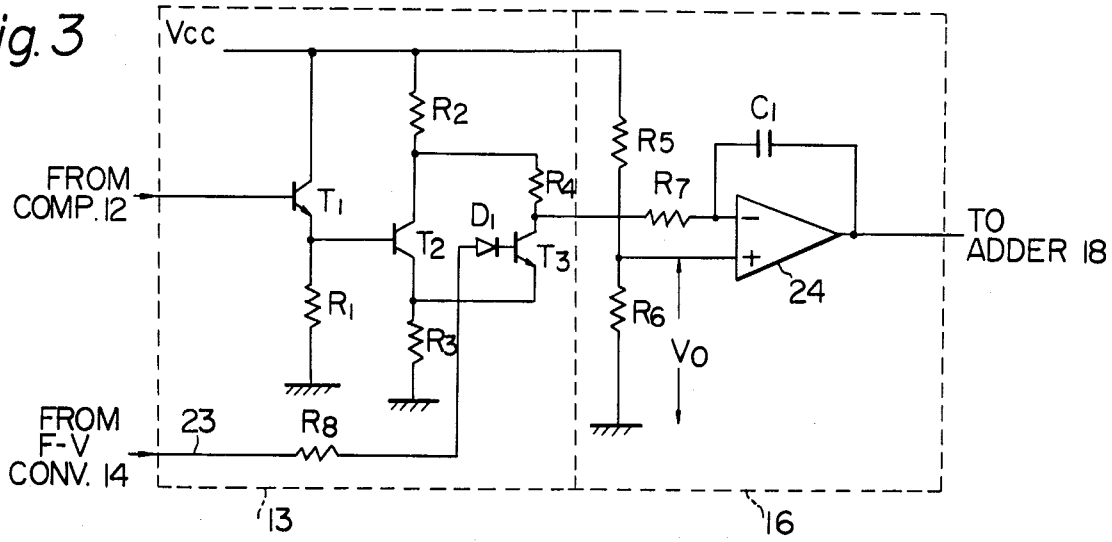
FIG. 3 is an exemplary circuit of a part of the FIG. 1 embodiment.

One example of the circuitry required to perform the functions of slicer 13 and integrating control amplifier 16 is shown in FIG. 3. The slicer 13 comprises transistors T1, T2 and T3. The NPN transistor T1 has its collector connected to a voltage source Vcc, its emitter connected to ground via a resistor R1 in an emitter follower configuration and its base electrode connected to the output of comparator 12. The PNP transistor T2 has its collector grounded via a resistor R3, its emitter connected to Vcc via a resistor R2, and its base electrode connected directly to the emitter of transistor T1. To the collector electrode of transistor T2 is connected the emitter of NPN transistor T3 and to the emitter of transistor T2 is connected the collector of transistor T3 via a resistor R4. The transistor T3 has is base electrode connected to the output of frequency-to-voltage convertor 14 via a diode D1 and resistor R8.

Figure 4:
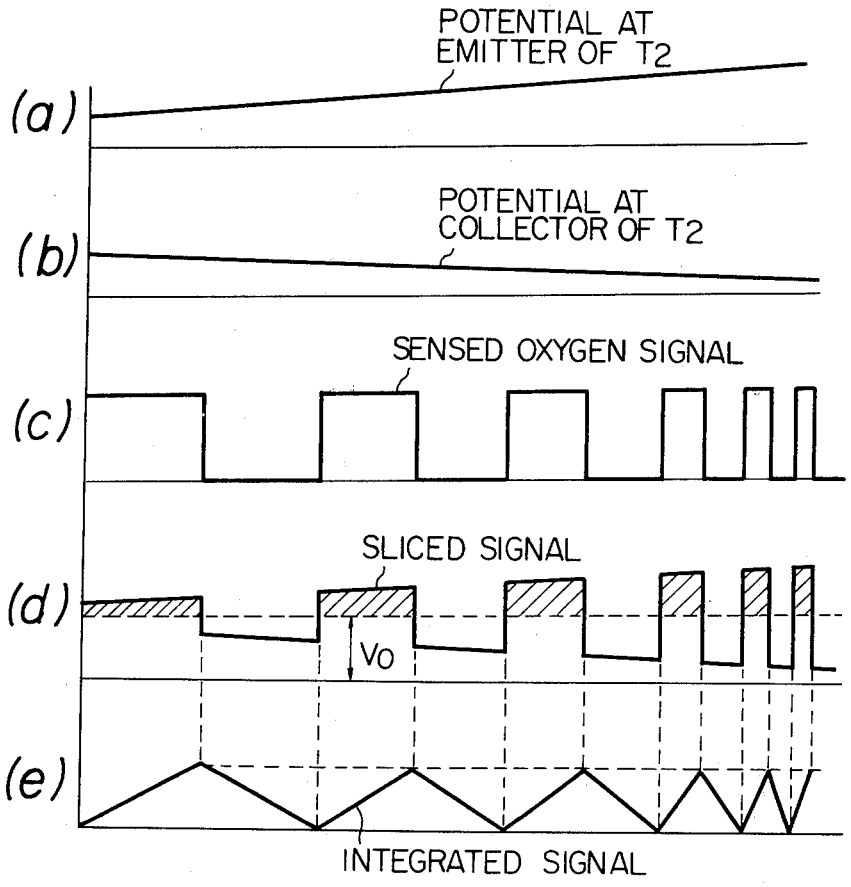
FIG. 4 is a waveform diagram useful for describing the operation of the FIG. 1 embodiment.

When the output from comparator 12 is connected to the base of transistor T1, the current that passes through the emitter to base of transistor T1 varies in proportion to the voltage developed across the resistor R1. The current that flows through the emitter collector path of transistor T2 is thus inversely proportional to the potential at its base electrode. Therefore, switching occurs in transistor T2 in response to the comparator output. With the output from convertor 14 being applied to the base of transistor T3, the current that passes through the collector emitter path of transistor T3 results in changes in voltage at the emitter and collector electrodes of transistor T2. The potential at the emitter of transistor T2 is caused to vary in proportion to the output of frequency-to-voltage convertor 14, while the potential at the collector of T2 is caused to vary in inverse proportion to the convertor output as shown in FIGS. 4*a* and 4*b*. The switching of transistor T3 occurs in response to the switching of transistor T2. The voltage delivered from the collector of transistor T3 becomes as shown in FIG. 4*d* when the comparator output of FIG. 4*c* is applied to the transistor T1.

It will be noted that the comparator output voltage is cut off by the potentials at the emitter and collector electrodes of transistor T2 and the sliced voltage thus fluctuates substantially in equal amplitude from a voltage $V_o$ obtained from the junction between resistors R5 and R6 of integrating control amplifier 16.

The control amplifier 16 comprises an operational amplifier 24 having its inverting input terminal connected to the collector of tansistor T3 via a resistor R7 and to its output terminal via a capacitor C1, the noninverting input terminal being connected to the junction between the resistors R5 and R6. The integrating capacitor C1 is thus charged when the potential at the inverting input is above the voltage $V_o$ and is discharged when the former is below the latter. The voltage at the output of integral controller 16 rises linearly as the input to the inverting input terminal of amplifier 24 is higher than $V_o$ and falls linearly to zero as the input voltage is below $V_o$. Since the duration of pulses delivered from the comparator 12 is inversely proportional to the speed of the engine 11, while the pulse amplitude is proportional thereto, the area under the curve of sliced signal and below the voltage $V_o$ is substantially equal to each other and the shaded areas are also substantially equal to each other. This results in triangular waveforms as shown in FIG. 4*e* in which the waveforms have an equal amplitude.

It will be noted therefore that even though the integral controller 16 has a constant integration rate determined by resistor R7 and capacitor C1, the integral controller 16 provides an output which varies as if the integration rate is caused to change in accordance with a parameter of the engine 11.

Since the amplitude of the output from the integral controller 16 has a constant maximum value irrespective of the variation of engine speed, the degree of perturbation from the desired air-fuel ratio is held constant at all times.

Figure 2:
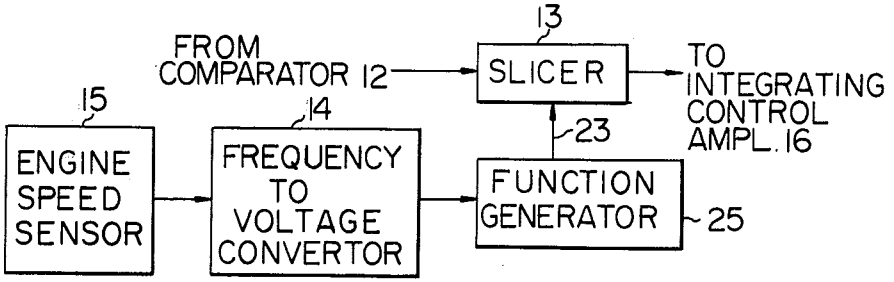
FIG. 2 is a circuit block diagram of a preferred form of the circuit of FIG. 1.

As required, the fuel injection control system of FIG. 1 may be provided with a function generator 25 connected between the output of frequency-to-voltage convertor 14 and the input to slicer 13 over lead 23 as illustrated in FIG. 2. The function generator 25 generates a voltage as a function of a parameter of the engine in order to relate the slicing levels with a parameter of the engine to even more improve the response characteristic of the system.

Figure 5:
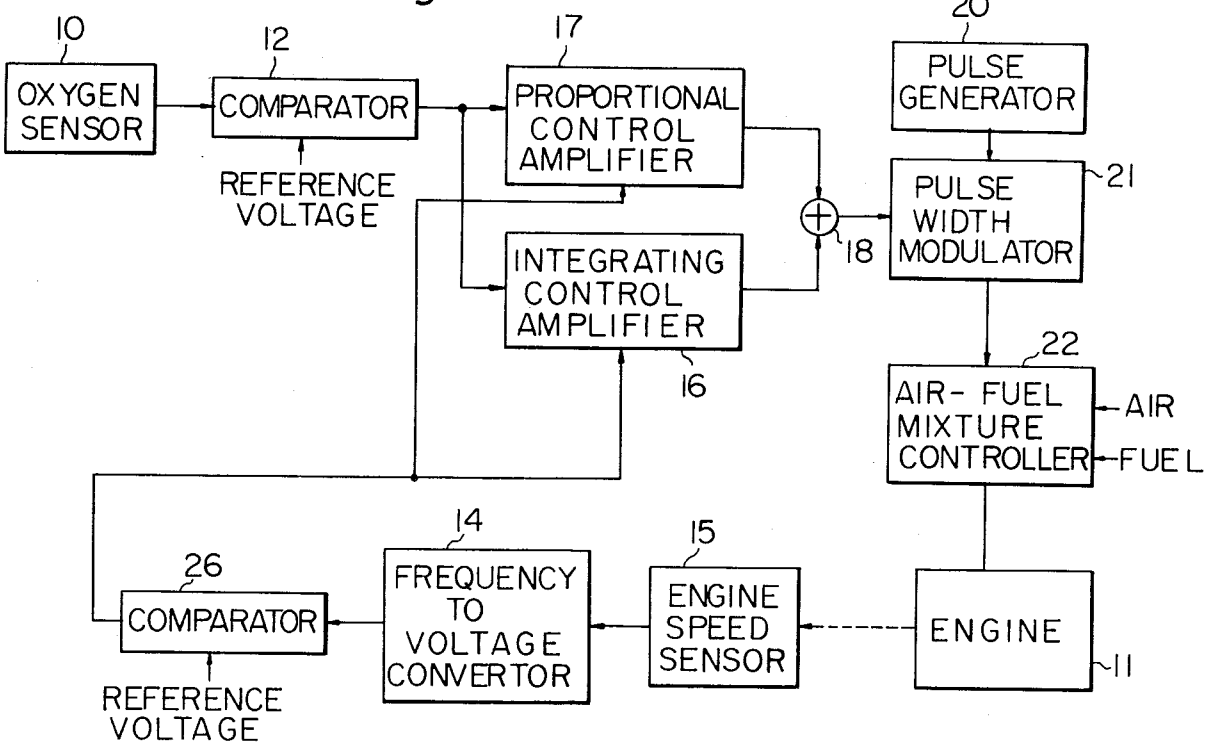
FIG. 5 is a circuit block diagram of an alternative arrangement of the FIG. 1 embodiment.

An alternative embodiment of the system of FIG. 1 is shown in FIG. 5 in which similar numbers are used to indicate the similar parts to that shown in the preceding Figures. The system of FIG. 5 is generally similar to that shown in FIG. 1 except that a comparator 26 is connected between the output of frequency-to-voltage convertor 14 and reset input terminals of integrating control amplifier 16 and proportional control amplifier 17. In the comparator 26, the speed representative voltage from the convertor 14 is compared with a reference voltage and an output is provided when the input exceeds the reference voltage so that a signal at one of two discrete values is generated depending on whether the engine speed is above or below a predetermined value represented by the reference voltage.

Figure 6:
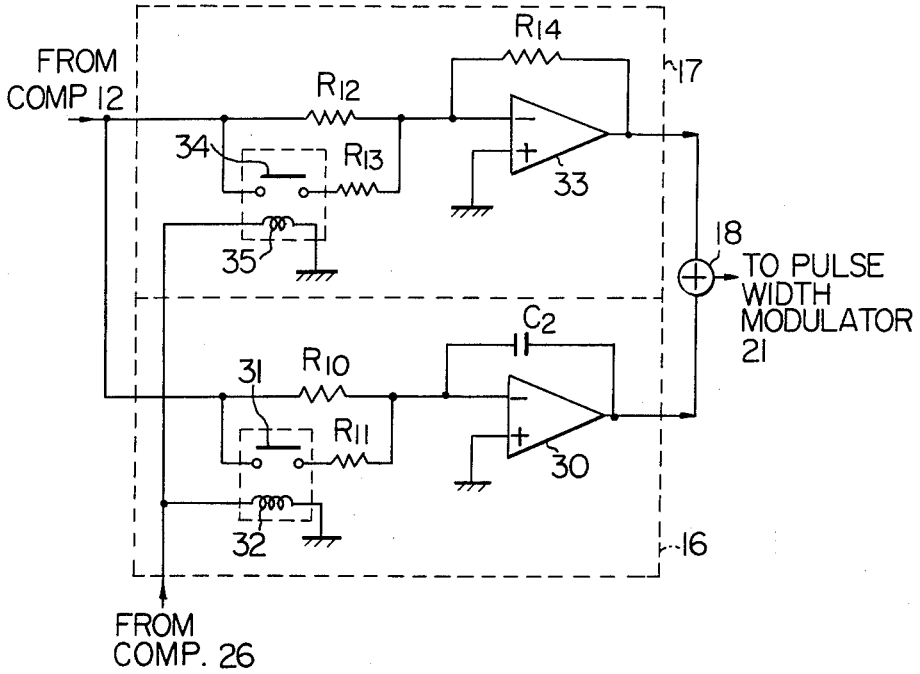
FIG. 6 is a detailed circuit diagram of the control amplifiers of the FIG. 5 embodiment.

The comparator output is used to control the integrating gain of amplifier 16 and the gain of amplifier 17. In order to achieve control of the integrating gain, the amplifier 16 comprises, as shown in FIG. 6, an operational amplifier 30 having its inverting input terminal connected to the output of comparator 12 via a resistor R10 and to the output terminal of the amplifier via a capacitor C2, and its noninverting input connected to ground. The resistor R10 is shunted by a resistor R11 via a normally open relay contact 31 operated by the relay coil 32 which is energized by a current supplied from comparator 26 to ground.

Normally, the resistor R11 is out of circuit and only resistor R10 contributes to the determination of the integration rate of integrator control 16. When a command signal is delivered from the comparator 26, the relay coil 32 is energized to close the contact 31 so that resistor R11 is brought into parallel circuit with resistor R10. This increases the integration gain of the controller 16 to compensate for the disturbance caused by the variation in the engine speed.

Since the delay time decreases with the engine speed, it is preferable that the reference voltage supplied to comparator 26 be chosen such that the change of integration rate occurs at a relatively low engine speed.

The proportinal control amplifier 17 may also comprise, as shown in FIG. 6, an operational amplifier 33 having its inverting input coupled to the output of comparator 12 via a resistor R12 and to its output terminal via a resistor R14 and its noninverting input coupled to ground. Resistor R12 is shunted by a resistor R13 and a normally open relay contact 34 operated by the relay coil 35 which may be connected to the output of comparator 26.

Upon energization of the coil 35 by current supplied from comparator 26, the resistor R13 is brought into parallel circuit with resistor R12. This increases the gain of amplification of the controller 17 in response to the engine speed upon reaching the predetermined value.

This arrangement permits simultaneous control of the gains of the both integral and proportional control amplifier.

The delay time also decreases with the mass of air flow introduced into the engine cylinders. The information on the mass of air flow can also be utilized to control the gain of the control amplifier in order to reduced the degree of perturbation from the desired air-fuel ratio.

Figure 7:
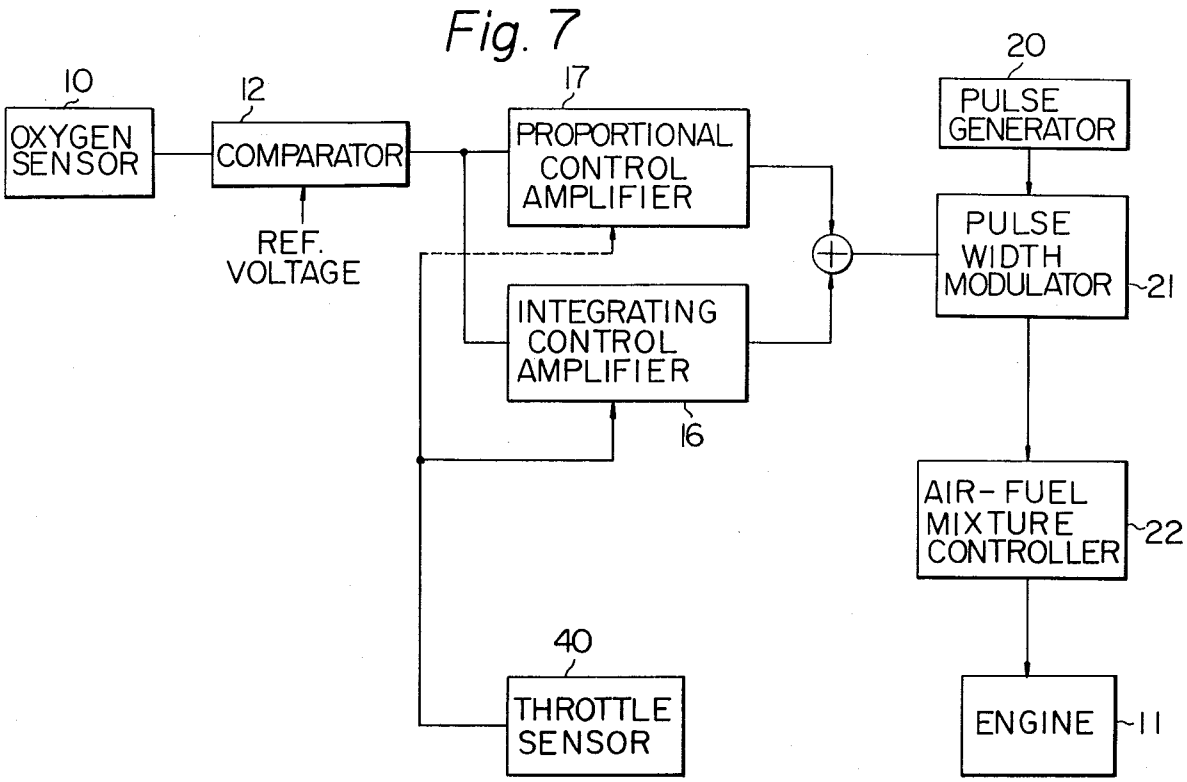
FIG. 7 is a circuit block diagram of a second embodiment of the invention.

The circuit diagram shown in FIG. 7 employs a throttle sensor 40 which senses the throttle opening which is a measure of the air flow introduced into the engine 11. In FIG. 7 similar numerals are used to indicate similar parts to those shown in the preceding Figures.

Figure 8:
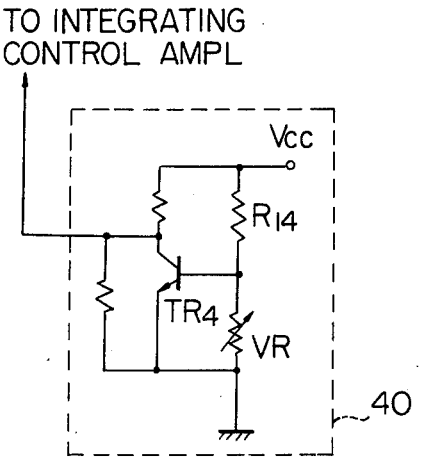
FIG. 8 is an exemplary circuit of the throttle sensor of the FIG. 7 embodiment.

The output from the throttle sensor 40 is connected to the integrating control amplifier 16 and to the proportional control amplifier 17 of the resettable type as described with reference to FIG. 6. The throttle sensor 40 may comprise, as shown in FIG. 8, series-connected resistor R14 and variable resistor VR connected between a DC voltage source Vcc and ground, a transistor TR4 having its collector and emitter electrodes connected to the voltage source Vcc and ground, respectively, and its base electrode connected to the junction between resistors R14 and VR. The value of resistance VR is arranged to vary inversely proportional to the throttle opening and develops thereacross a voltage inversely proportional to the throttle opening. Transistor TR4 turns off when the voltage across the resistor VR is below a predetermined value which is set by the value of resistor R14 when the mass of intake air flow is above a value preset value. The collector of transistor TR4 is connected to the relay coil 32 of the integrating controller 16 (FIG. 6). When the transistor TR4 turns off, the voltage at the collector rises to a high level and the throttle sensor 40 energizes the coil 32 so that resistor R11 is brought into parallel circuit with resistor R10. Therefore, the integrating gain of amplifier 16 is incrased by the signal from the throttle sensor when the throttle opening is above a predetermined value.

As described previously, the proportional control amplifier 17 may be of the resettable type and may also be controlled by the signal from the throttle sensor 40 by connection as indicated in dashed lines.

What is claimed is:

1. Apparatus for controlling the air-fuel mixture ratio of internal combustion engines having means for adjusting the ratio of air to fuel supplied to the engines, comprising:

means for sensing the composition of the exhaust gases and providing a composition representative signal having one of two discrete values depending upon whether the sensed composition is above or below a predetermined value;

means for sensing an operating parameter of said engine and providing a parameter representative signal;

means connected to said composition sensing means and to said parameter sensing means for slicing the amplitude of said composition representative signal as a function of said sensed parameter, the sliced amplitude being proportional to the parameter of the engine;

an integrating controller connected to said amplitude slicing means for integrating the sliced signal to generate a control signal which is continuously variable with respect of time;

means for generating a series of pulses; and means connected to said pulse generating means and to said integrating controller for modulating the duration of said pulses as a function of the value of said control signal, said modulated pulses being connected to said air-fuel ratio adjusting means.

2. Apparatus as claimed in claim 1, further comprising a proportional controller connected to said composition sensing means for generating a second control signal having a constant amplitude, and means for adding said first and second control signals, said added signal being connected to said pulse duration modulating means.

3. Apparatus as claimed in claim 1, wherein said integrating controller comprises an operational amplifier and a capacitor, said operational amplifier having first and second input terminals and an output terminal, the first input terminal being connected to a source of a constant potential, the second input terminal being connected to the output of said slicing means, said capacitor being connected across the output of said operational amplifier and said second input terminal, said constant potential being chosen such that said capacitor is charged when said potential is below the instantaneous value of said composition representative signal and the energy stored in the capacitor is discharged when said potential is above the instantaneous value of said composition representative signal.

4. Apparatus as claimed in claim 1, wherein said operating parameter sensing means includes means for sensing the speed of said engine.

5. Apparatus as claimed in claim 1, further comprising a function generator, and wherein the output of the parameter sensing means is connected to said amplitude slicing means via said function generator as a function of a predetermined characteristic of said engine.

6. Apparatus for controlling the air-fuel mixture ratio of internal combustion engines having means for adjusting the ratio of air to fuel supplied to the engine, comprising:

means for sensing a composition of the exhaust gases and providing a composition representative signal having one of two discrete values depending upon whether the sensed composition is above or below a predetermined value;

means for sensing the speed of said engine and providing a speed representative signal having one of two discrete values depending upon whether the sensed speed is above or below a predetermined value;

an integrating controller connected to said composition sensing means for integrating the discrete values of said composition representative signal to generate a control signal which is continuously variable with respect to time, said integrating controller including an operational amplifier, an integrating capacitor and first and second resistors, said operational amplifier having first and second input terminals and an output terminal, said integrating capacitor being connected across said output and first input terminals, said first input terminal being connected to the output of said composition sensing means via the first resistor and further connectable thereto via the second resistor, said first and second resistors forming two RC circuits of different time constants with said integrating capacitor, the second input terminal of the operational amplifier being connected to a reference potential;

means responsive to said speed representative signal to control the connection betwen the first input terminal and the output of said composition sensing means via the second resistor to thereby switch between said different time constants;

means for generating a series of pulses;

means connected to said pulse generating means and to said integrating controller for modulating the duration of said pulses as a function of the value of said control signal, said modulated pulses being connected to said air-fuel ratio determining means;

a proportional controller connected to said composition sensing means for generating a second control signal of a constant value for a given value of said composition representative signal, said proportional controller including a second operational amplifier, third, fourth and fifth resistors, said second operational amplifier having first and second terminals and an output terminal, said third resistor being connected across the first input and output terminals of said second amplifier, said first input of the second amplifier being connected to the output of said composition sensing means via the fourth resistor and further connectable thereto via the fifth resistor;

means responsive to said speed representative signal to

7. Apparatus for controlling the air-fuel mixture ratio of internal combustion engines having means for determining the ratio of air to fuel supplied to the engine, comprising:

means for sensing a composition of the exhaust gases and providing a composition representative signal having one of two discrete values depending upon whether the sensed composition is above or below a predetermined value, means for sensing air flow to said engine and providing an air-flow representative signal having one of two discrete values depending upon whether sensed air flow is above or below a predetermined value;

an integrating controller connected to said composition sensing means for integrating the discrete values of said composition representative signal to generate a control signal which is continuously variable with respect to the time, said integrating controller including an operational amplifier, an integrating capacitor and first and second resistors, said operational amplifier having first and second input terminals and an output terminal, said integrating capacitor being connected across said output and first input terminals, said first input terminal being connected to the output of said composition sensing means via the first resistor and further connectable thereto via the second resistor, said first and second resistors forming two RC circuits of different time constants with said integrating capacitor;

means responsive to said air-flow representative signal to control the connection between said first input terminal and the output of said composition sensing means via the second resistor to thereby switch between said different time constants;

means for generating a series of pulses;

means connected to said pulse generating means and to said integrating controller for modulating the duration of said pulses as a function of the value of said control signal, said modulated pulses being connected to said air-fuel ratio determining means;

a proportional controller connected to said composition sensing means for generating a second control signal of a constant value for a given value of said composition representative signal, said proportional controller including a second operational amplifier, third, fourth, and fifth resistors, said second operational amplifier having first and second input terminals and an output terminal, said third resistor being connected across the first input and output terminals of said second amplifier, said first input of the second amplifier being connected to the output of said composition sensing means via the fourth resistor and further connectable thereto via the fifth resistor, means responsive to said air-flow representative signal to control the connection between said second input terminal of the second amplifier and the output of said composition sensing means via the fifth resistor; and an adder for adding said first and second control signals, said added signal being connected to said pulse duration modulating means.

* * * * *

UNITED STATES PATENT OFFICE

CERTIFICATE OF CORRECTION

Patent No. 4,029,061 Dated June 14, 1977

Inventor(s) Masaharu Asano

It is certified that error appears in the above-identified patent and that said Letters Patent are hereby corrected as shown below:

Claim 6, line 60, after "to" insert --control the connection between said first input terminal of the second amplifier and the output of said composition sensing means via the fifth resistor; and an adder for adding said first and second control signals, said added signal being connected to said pulse duration modulating means, the second input terminal of the second operational amplifier being connected to a reference potential in common with the second input terminal of the first operational amplifier.--

Signed and Sealed this

*Fifth* Day of *August 1980*

[SEAL]

*Attest:*

SIDNEY A. DIAMOND

*Attesting Officer*

*Commissioner of Patents and Trademarks*